US005927714A

United States Patent [19]

Kaplan

[11] Patent Number: 5,927,714

[45] Date of Patent: Jul. 27, 1999

[54] INTERACTIVE TIC-TAC-TOE SLOT MACHINE

[76] Inventor: Edward Kaplan, P.O. Box 1155, Absecon, N.J. 08201

[21] Appl. No.: 09/021,446

[22] Filed: Feb. 10, 1998

[51] Int. Cl.[6] ..... G07F 17/34

[52] U.S. Cl. ..... 273/143 R; 463/20

[58] Field of Search ..... 273/143 R, 138.2, 273/138 A; 463/20

[56] References Cited

U.S. PATENT DOCUMENTS

| | | | |
|---|---|---|---|
| 4,838,552 | 6/1989 | Hagiwara | 463/20 |
| 4,874,173 | 10/1989 | Kishishita | 273/143 R |
| 5,423,539 | 6/1995 | Nagao | 273/143 R |
| 5,584,764 | 12/1996 | Inoue | 273/143 R |

FOREIGN PATENT DOCUMENTS

| | | | |
|---|---|---|---|
| 2117546 | 10/1983 | United Kingdom | 273/143 R |
| 2242300 | 9/1991 | United Kingdom | 273/138 A |

*Primary Examiner*—Benjamin H. Layno
*Attorney, Agent, or Firm*—Edwin E. Greigg; Ronald E. Greigg

[57] ABSTRACT

A Tic-Tac-Toe slot machine having three parallel spaced reels. The reels are covered around their circumference with reel strips having spaced symbols of two different configurations such as "X" and "O" and blank. The X's and O's blanks are intermixed on each strip in an orderly fashion. Having three of the same symbols in an aligned row designates a winner. With a slot machine having a window that displays three rows of symbols there are eight possible winning rows. Three rows in different horizontal planes, three rows in vertical planes and from corner to corner in the form of an X. The slot machine can be played with from one to eight coins. For all possible winners one must play eight coins. The slot machine having the option of spinning a choice reel again to induce an interactive play. The slot machine is operated mechanically in the same manner as present day existing slot machines.

7 Claims, 1 Drawing Sheet

INTERACTIVE TIC-TAC-TOE SLOT MACHINE

This invention is directed to a slot machine and more particularly to a slot machine in which an eight-way payout is generated, reminiscent of the game of TIC-TAC-TOE.

BACKGROUND OF THE INVENTION

It is well known that slot machines of various types are used in the game-of-chance industry. These slot machines display different fruits, bars, blank spaces, cards, etc. A payout is made in accordance with a scheme in which certain pre-selected alignments of the indicia shown in the display windows occur. Slot machines usually have three or more side-by-side reels that rotate in a vertical plane. A payout is usually made by aligning a winning display in horizontal lines across each of the three reels. Usually when one coin is played a winning combination is displayed in a single horizontal line. If additional coins are played additional horizontal display combinations can be used for a payout. For instance, a slot machine may display three different horizontal combination alignments. A payout is made for a winning display combination in the middle horizontal line for one coin played. The upper line can be played for a second coin and the bottom line can be played for a third coin. Additionally some machines accept up to five coins, so that in addition to the above scheme, winning combinations can be made in an alignment of display windows in an X format where a fourth coin would win along one leg of the X and a fifth coin will win along the other leg of the X. Thus, for such machines, five coins can be played for five different winning combinations. A typical reel type machine can be used for any number of coins played and for different arrangements of winning combinations up to five different winning combinations.

In addition to reel type machines, electronic display machines are now in use for different combinations of card games, such as Black Jack and Poker in which this design can be implemented.

SUMMARY OF THE INVENTION

This invention differs over any prior art known slot machine in which an existing three reel side-by-side vertical rotatable mechanism or electronic display is used. In carrying out this invention, the reel strips are changed to display symbols such as X's and O's and blanks. Other symbols could be used; however, this invention is directed to using a three-reel slot machine to play TIC-TAC-TOE. In playing TIC-TAC-TOE it is known to use an X and O to differentiate between two players movements. Therefore, it is proposed that the reel strips be changed to display X's and O's.

It is therefore an object of this invention to set forth a three reel slot machine for displaying running combinations of X's and O's in which the winning combination arrangement aligns three X's or three O's in a row.

A further object is to set forth a slot machine for playing TIC-TAC-TOE in which as many as eight winning combinations can be displayed.

The invention will be better understood and further objects and advantages thereof will become more apparent from the ensuing detailed description of a preferred embodiment taken in conjunction with the drawings.

BRIEF DESCRIPTION OF THE DRAWINGS

The drawing illustrates a display of a slot machine illustrating different payout lines, reels with symbols and operating buttons.

DETAILED DESCRIPTION OF THE PREFERRED EMBODIMENT

Figure 1:
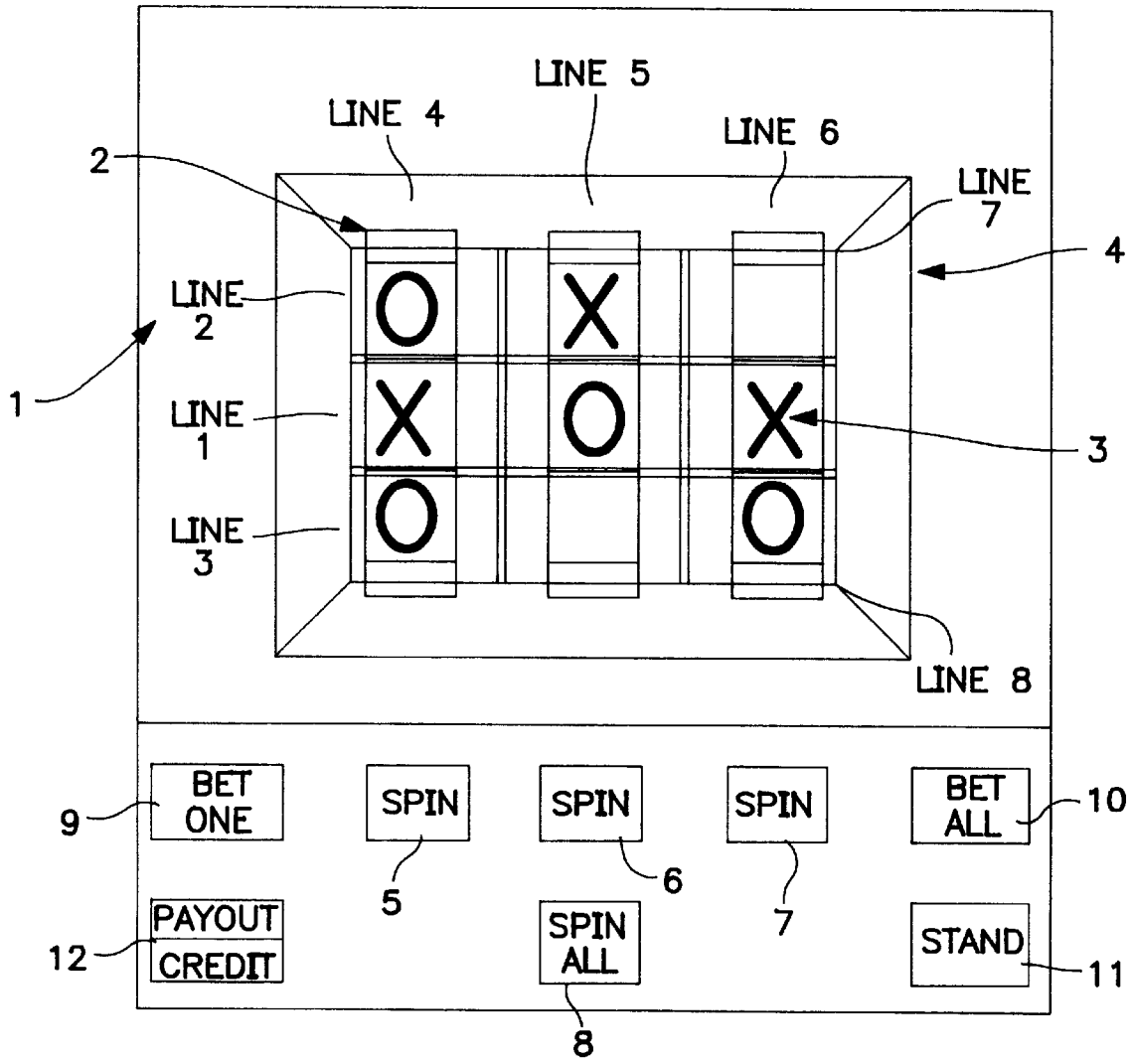

The drawing (FIGURE 1) illustrates a frontal display (4) of a vertically rotatable, three reel slot machine in which each of the reel strips include an assembly of X's and O's and blanks (3). For a winning combination, three X's or three O's must be aligned in sequence along the same row such as in a commonly played game of TIC-TAC-TOE. In this slot machine, there are eight possible winning combinations (1). Thus, in a game of chance, eight coins could be played, one coin for each different possible winning combination lines (1). The eight winning combinations are as follows and may represent a winning combination for each coin played in the following order. The middle horizontal line (Line 1) would payout for the first coin, the upper horizontal line (Line 2) for the second coin; the bottom horizontal line (Line 3) for the third coin. Combination vertically displayed on each reel from the left to the right (Lines 4,5,6) for the fourth through the sixth coin. Alignment from the upper left symbol through the middle and down to the lower right symbol for the seventh coin (Line 7); and for the eighth coin in a line (Line 8) from the upper right symbol through the middle symbol and down to the lower left symbol. Each of the first through the third coins would win if any combination of three X's or three O's appear in the horizontal line (Line 1,2,3). The fourth through the sixth coins would require any combination of three X's or three O's on the reels displayed vertically in order from the top to the bottom (Line 4,5,6). And the seventh and eighth coin would require any combination of three X's or three O's in an alignment such as one leg of an X (Line 7,8). For the display shown in the drawing (FIGURE 1) only the eighth coin would be a winner since three O's are aligned along one leg of an X, which is line eight. The number of coins for any winning combination can be in accordance with the payout arrangement of the machine. For instance, if the entire display is all X's or O's the payout would be the jackpot. Each of the payout lines are separate and each of the payout lines are for a specific coin played. The above arrangement of proposed payouts from the first coin to the eighth coin is a suggested payout scheme. It would be obvious to anyone skilled in the art that the payout for each coin played could be structured in a different pay order and would depend on the manner in which the machine was programmed. The scheme as set forth above would be preferred.

A slot machine having three reels (2) that rotate in side-by-side horizontal planes could be used and the payout scheme could be arranged as set forth above or changed to a different order in accordance with the reel arrangement. Such a slot machine display would be shown if the drawing figure were to be rotated 90°.

In carrying out the invention each of the reels will be covered over its entire circumference with a reel strip having exposed spaced symbols such as X's and O's and blanks. The spacing of the symbols (3) on the strips and the stopping position of each reel should be such that three symbols including blanks (3) on each reel will be seen when viewing the window and the center symbol will be at the middle of the window vertically. The symbols will be placed on the reel strips in a mixed fashion so that in one section the X's and O's can alternate with each other. In another section two X's and then two O's can be placed on the strip in series. In order to have a jackpot payout the entire window display would have the same symbols in each of the nine positions. Therefore, each strip must have at least one section with three X's in sequential alignment and at least one section with at least three O's in sequential alignment.

The slot machine is set up with each of the three reels (2) having a strip of pre-arranged symbols (3) thereon, that is, X's and O's and blanks or some other symbols in the same configuration. The slot machine is programmed for a payout for each of the rows having three of the same symbols in alignment. The player will insert from one to eight coins in the machine and then a handle or start button (8 or 10) will be operated. Each of the reels (2) will rotate independently of each other and will stop at different times so that nine symbols (3) will appear in the window with the symbols (3) aligned horizontally and vertically. Any of the payout lines (1) indicated above that has three symbols (3) of the same configuration such as three X's or three O's in alignment will be a winner. After the reels (2) have stopped, the player evaluates the winnings and has the option to spin one reel again of their choosing to try to increase their winnings using spin buttons (5,6,7) or stand and keep their winnings using button (11) or collect their winnings using button (12). A player has the ability to play again using buttons 9,10 thereby increasing his odds of winning. That form of play, without the deposit of additional coins, makes this an "interactive" slot machine by allowing the player to interact directly with the machine. As shown in the drawing (FIGURE 1) only payout line 7 has three O's; therefore, payout line 7 would be a winner and the other seven payout lines would be a loser.

Whenever a row of three of the same symbols (3) are in line, that payout line will pay the player only if that player bet on that payout line. Also in the design, the game would be either to bet on the "X" or the "O" before the game is played for a bonus payout, or can be used to try to double your winnings. Or another way to play would be to bet what lines can be played by pressing a button at each line you want to bet, you must have bet the amount played. Many variations can be made for this game. No major electronics will need to be changed. All that would need to be changed is the reel strips and the ROMs for the computer of the machine to be converted. Also needed to be changed would be the glass face of the machine to understand the payout sequence.

THE PLAY

Along the bottom of the slot machine display (2) are the control buttons each of which has words designated. After the desired amounts of coins are deposited, the player will press the spin all button (8) to spin all reels. After the reels have stopped, the spin buttons (5,6,7) will provide an opportunity for the player to spin an independent reel one more time if the player choose to try to improve upon the payout. If the player does not desire to try to increase their winnings the player pushes the stand button (11) in order to keep their winnings indicated. The payout—credit button (12) affords the player the opportunity to cash out any earnings or credit the machine for more play, that is if the player has any winnings. The player winnings can be added as credits so the machine can be played by the use of the bet one button (9) or bet all button (10) so the player can use credits rather than depositing more money into the slot machine, not shown. Each button will illuminate at a designated time to ensure that the player has less confusion on how to play. Example: after the player has deposited the amount of coins of desire, the bet one button (9) will light and the spin all button (8) will flash. If the player has deposit at least eight coins the bet all (10) button will also light. After the spin all button (8) has been pressed all reels will spin. After all reels have stopped the spin buttons (5,6,7) will light and the stand button (11) will flash. This process with the lighted buttons will help the player enjoy the game.

The foregoing relates to preferred exemplary embodiments of the invention, it being understood that other variants and embodiments thereof are possible within the spirit and scope of the invention, the latter being defined by the appended claims.

What is claimed:

1. An interactive TIC-TAC-TOE slot machine having spaced reels which operate in parallel planes, each said reel adapted to spin separately in response to deposit of at least one coin in said machine, each of said reels including a reel strip on a circumference of the reel on which at least two different symbols are displayed, said different symbols constitute X's and O's which are equally spaced and intermixed in an orderly arrangement on said reel strip, said symbols may be disposed in alternation with each other along a first portion of the strip, each said strip has a second portion having three X's disposed in succession and a third portion having three O's disposed in succession, wherein the symbols fill the strip with X's, O's and blanks, said slot machine has a display window through which at least one symbol on each reel is displayed in alignment, and selection means are provided to allow at least one of said reels to be spun a further time, whereby a player's chances of winning are increased.

2. A TIC-TAC-TOE slot machine as set forth in claim 1, in which said at least one row of symbols are aligned in a horizontal plane.

3. A TIC-TAC-TOE slot machine as set forth in claim 2, in which there are three rows of symbols displayed in said window.

4. A TIC-TAC-TOE slot machine as set forth in claim 3, in which said reels of said slot machine rotate in vertical planes.

5. A TIC-TAC-TOE slot machine as set forth in claim 1, in which there are three rows of symbols displayed in said window.

6. A TIC-TAC-TOE slot machine as set forth in claim 5, in which said reels of said slot machine rotate in vertical planes.

7. A TIC-TAC-TOE slot machine as set forward in claim 6, in which any one of said three reels can be activated again.

* * * * *